US006516889B1

(12) United States Patent
Lembcke et al.

(10) Patent No.: US 6,516,889 B1
(45) Date of Patent: Feb. 11, 2003

(54) HIGH-LOAD BIG BORE LOCK

(75) Inventors: Jeffrey J. Lembcke, Cypress, TX (US); Kurt A. Hickey, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/651,039

(22) Filed: Aug. 30, 2000

(51) Int. Cl.[7] ..... E21B 23/01
(52) U.S. Cl. ..... 166/381; 166/217; 175/423
(58) Field of Search ..... 166/118, 138, 166/206, 209, 216, 217, 373, 381; 175/423

(56) References Cited

U.S. PATENT DOCUMENTS 2,698,056 A 12/1954 Marshall et al.
3,677,346 A * 7/1972 Tamplen ..... 166/385
4,311,196 A 1/1982 Beall et al.
4,497,371 A 2/1985 Lindsey, Jr.
4,554,972 A 11/1985 Merritt
4,732,212 A 3/1988 Fraser, III

FOREIGN PATENT DOCUMENTS

GB 2158125 A 3/1985

* cited by examiner

*Primary Examiner*—David Bagnell
*Assistant Examiner*—Jennifer R Dougherty
(74) *Attorney, Agent, or Firm*—Steve Rosenblatt

(57) ABSTRACT

A high load wireline lock features a plurality of dogs supported by a fishing neck. Radial loads, transmitted through the dogs when the lock is engaged, are in turn directed into the fishing neck in the manner so as to distribute the load into the wall of the fishing neck. The contact between the dogs and the fishing neck is along sloping surface which minimize the radial forces against the fishing neck and in turn applies forces in a near tangential direction through the wall of the fishing neck thus greatly increasing the load capacity of the wireline lock.

13 Claims, 2 Drawing Sheets

HIGH-LOAD BIG BORE LOCK

FIELD OF THE INVENTION

The field of this invention relates to lock mechanism for downhole use, and more specifically, to locks used in wireline applications.

BACKGROUND OF THE INVENTION

Wireline locks have been in use in the oil field for many years. These generally involve outward displacement of dogs into a receiving groove to hang on to a downhole tool. A typical prior art lock is shown in FIGS. 1 and 2. FIG. 2 is a section view through the dog 10. FIG. 2 illustrates that the fishing neck 12 has a ramp surface 14 which in the view of FIG. 1 cams the dogs 10 outwardly into a mating recess for engagement of the downhole tool (not shown). The position in FIG. 1 is retained by a split ring 16. Arrows 18 in FIG. 2 represent the radial forces brought to bear on fishing neck 12 by the dogs 10. Each of the dogs 10 have circumferential contact along the outer surface 20 of the fishing neck 12 thus making the direction of the force imparted from the dogs 10 to the fishing neck 12 occur principally along the normal axis as revealed by arrows 18. Normally, the collapse load placed on the fishing neck 12 represented by arrows 18 is insufficient to collapse the fishing neck 12. Generally speaking, pressure of axial loads on the wireline lock illustrated in FIGS. 1 and 2 load the locking dogs 10 with the result of such dogs 10 are pushed inward. The collapse or bending load applied to the fishing neck 12 is illustrated by arrows 18.

One problem occurs when locks of the prior art as illustrated in FIGS. 1 and 2 are required to sustain high loads by pressure from slam closures at very high flow rates when the lock is used in conjunction with wireline safety valve. The slam closures result in abrupt pressure build up which heighten the magnitude of the bending and collapse force represented by arrows 18. The slam closure phenomenon when combined with very large bore requirements through the lock which in turn results in a very thin cross section for the fishing neck 12 in the area of the dogs 10 which must resist such collapse force, presents a design challenge addressed by this invention.

U.S. Pat. Nos. 4,711,326; 4,762,177; 4,311,196; and 5,174,397 represent prior art known to the Applicants in the area of guidance systems for slips.

Accordingly, one of the objects of the present invention is to be able to accommodate slam closures and other downhole events which greatly heighten the applied stresses to the lock while at the same time avoiding having to lose bore size in order to provide a sufficiently thick wall to avoid collapse of the fishing neck 12. As a result, modifications have been made to the prior art design shown in FIGS. 1 and 2 which constitutes the present invention. The present invention objectives are to allow high loads to be transmitted from the dogs to the fishing neck in question on large sizes under high load situations without fear of collapse of the fishing neck. Those skilled in the art will appreciate the manner in which the invention solves the problem and its advantages by a review of a description of the preferred embodiment below.

SUMMARY OF THE INVENTION

A high load wireline lock features a plurality of dogs supported by a fishing neck. Radial loads, transmitted through the dogs when the lock is engaged, are in turn directed into the fishing neck in the manner so as to distribute the load into the wall of the fishing neck. The contact between the dogs and the fishing neck is along sloping surface which minimize the radial forces against the fishing neck and in turn applies forces in a near tangential direction through the wall of the fishing neck thus greatly increasing the load capacity of the wireline lock.

DESCRIPTION OF THE PREFERRED EMBODIMENT

Figure 3:
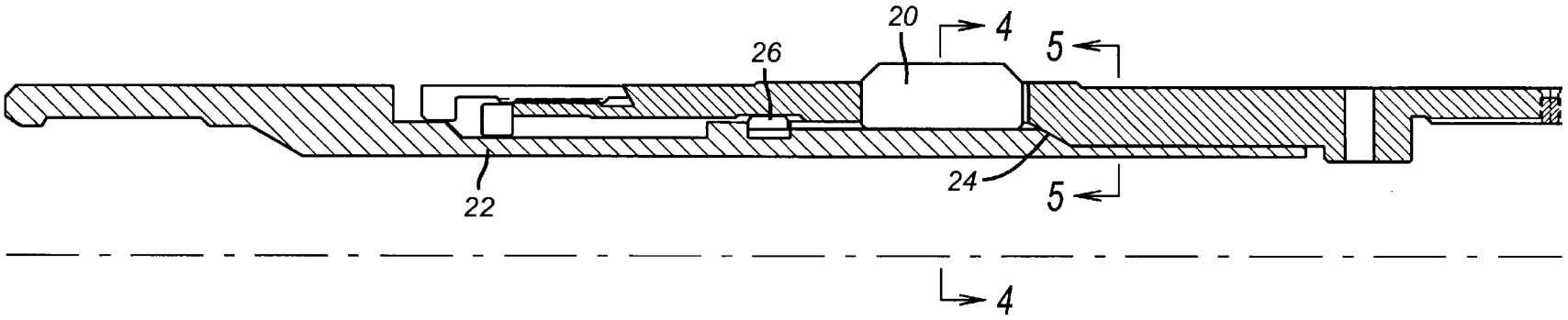
FIG. 3 is a section view of the wireline lock of the present invention.

Referring to FIG. 3 dogs 20, are cammed radially outwardly into the locked position by a fishing neck 22 due to sloping surface 24. The outward position of the dogs 20 is secured by split ring 26. The downhole tool such as a subsurface safety valve into which the dogs 20 would engaged is not shown. The wireline mechanism which ultimately supports the fishing neck 22 is also not shown. These components are standard components well known in the art.

Figure 4:
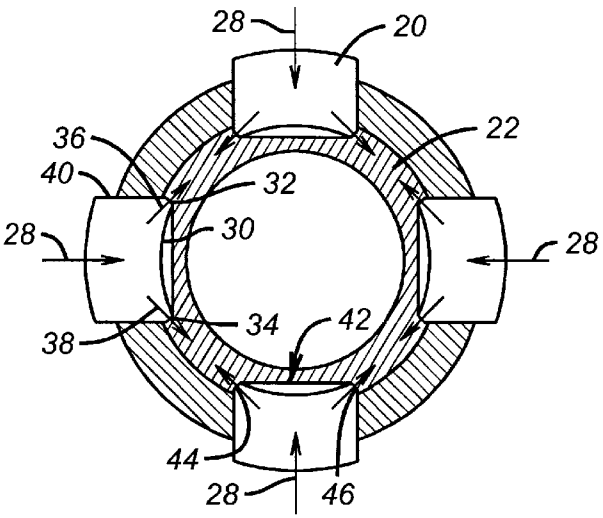
FIG. 4 is a section view through lines 4—4 of FIG. 3.

The present invention is best illustrated in FIG. 4. There the dogs 20 have an initially radially inward force represented by arrows 28. This force results from loading on the lock assembly such as when the subsurface safety valve which is being retained by the dogs 20 is allowed to slam shut. Looking closely at the dogs 20 it can be seen that they have an internal curved surface 30 which is not in contact with the fishing neck 22. On either end of the curved surface 30, are sloping surfaces 32 and 34 disposed at obtuse angles to surface 30 with the preferred angle being about 135°. The radially inward load represented by arrows 28 is directed along the sloping surfaces 32 and 34 as further represented by arrows 36 and 38 respectively. The angle of sloping surfaces 32 and 34 vary and in a preferred embodiment they can be in the order of 45° with respect to an edge such as 40 of the dog 20. While the details of one particular dog 20 have been described, those skilled in the art will appreciate that such descriptions are equally apt to the other dogs 20 illustrated in FIG. 4.

Figure 1:
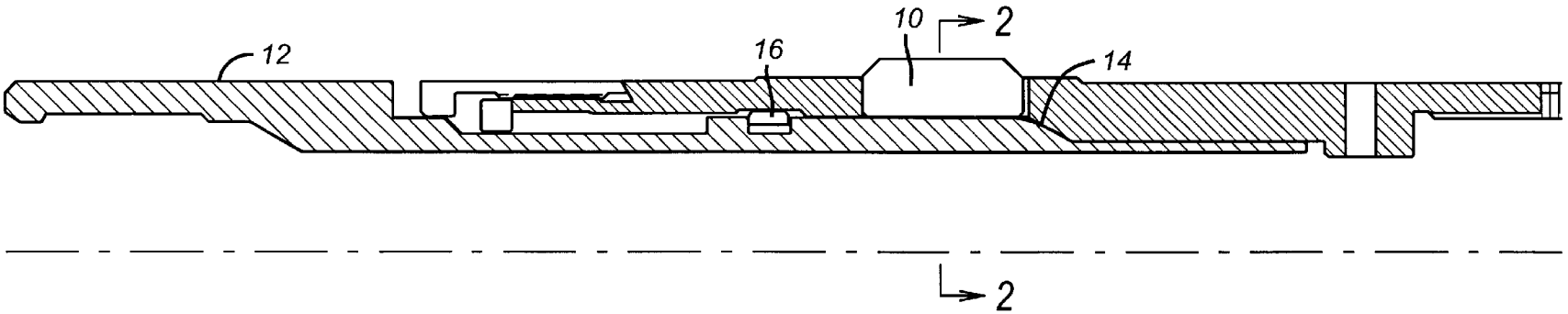
(PRIOR ART) FIG. 1
FIG. 1 is a sectional elevational view of a lock known in the prior art in the set position.
Figure 2:
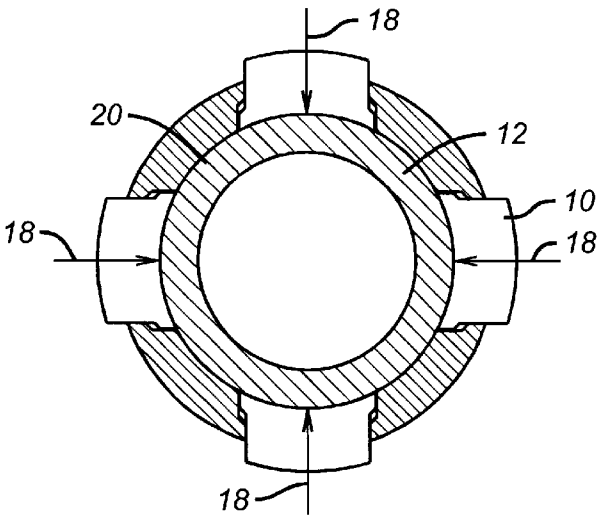
(PRIOR ART) FIG. 2
FIG. 2 is a section view through lines 2—2 of FIG. 1.
Figure 5:
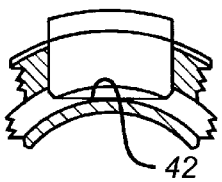
FIG. 5 is a section view through lines 5—5 in FIG. 3.

FIG. 4 also reflects that the fishing neck 22 has a groove 42 for guidance of each individual dog 20. The grooves 42 are identical to each other and have sloping surfaces 44 and 46 are preferably parallel to sloping surfaces 32 and 34 respectively for each individual dog 20. Accordingly, the radially inward load 28 is distributed from each dog 20 to the left and to the right as represented by arrows 36 and 38 respectively. Arrows 36 and 38 reflect that the load is transformed from acting radially inwardly toward a central axis on the fishing neck 12 of the prior art shown in FIG. 2 to nearly tangentially and into the wall of the fishing neck 22 in the present invention shown in FIG. 4. FIG. 5 illustrates a continuation of the groove 42 down the ramp 24.

It should be noted that the,interaction between surfaces 32 and 34 on a dog 20 with the counterpart surfaces 44 and 46 on the fishing neck 22 is for the purpose of re-directing the applied load in the lock assembly. The function of these interacting sloping surfaces is not to physically retain the dogs 20 in the fishing neck 22. Nor is the purpose of the mating sloping surfaces between the dog 20 and the fishing neck 22 for the purpose of guidance of the movement of the dogs 20. The underside relief in each of the dogs 20 represented by curved surface 30 in combination with the mating sloping surfaces insures that the radial component of loads transferred through the dogs 20 and represented by arrows 28 is minimized as a substantial portion of the load is transmitted into the wall of fishing neck 22. Thus, for example, if sloping surfaces 32 and 34 are at 45° the magnitude of the radial component represented by arrows 28 is reduced by more than a third from the design shown in FIG. 2. Those skilled in the art will appreciate that other angular configurations of sloping surfaces 32 and 34 can be used without departing from the spirit of the invention. Other shapes for surface 30 can also be used without departing from the spirit of the invention. The objective of the invention is to re-direct the radial load represented by arrows 28 into more of a circumferential direction into the wall of fishing neck 22.

Those skilled in the art will appreciate that what has been illustrated is the preferred embodiment of the invention and certain modifications and alterations to the preferred embodiment can be made within the scope of the invention whose limits are defined by the claims below.

We claim:

1. A lock assembly for downhole use, comprising:

a housing defining at least one window and further comprising a unitary tubular body having a central axis and movably mounted thereon; and at least one dog, said dog selectively extendable through said window cammed by said tubular body said tubular body configured to contact said dog to force it to move only radially in a manner which deflects reaction loading force on said tubular body from a radial direction oriented toward said central axis.

2. The assembly of claim 1, wherein:

said body and said dog comprise mating surfaces which direct forces applied to said dog in a direction of said central axis away from said central axis.

3. A lock assembly for downhole use, comprising:

at least one dog, said dog cammed by a tubular body having a central axis said body configured to contact said dog in a manner which deflects loading on said tubular body from a radial direction oriented toward said central axis;

said body and said dog comprise mating surfaces which direct forces applied to said dog in a direction of said central axis away from said central axis;

said tubular body comprises a groove said groove having a base surface oriented generally perpendicular to a radial line from said central axis and opposing end surfaces which extend from said base surface at an angle generally greater than 90° from said base surface;

said dog having contact surfaces which align with said opposing end surfaces on said groove.

4. The assembly of claim 3, wherein:

said dog further comprises an end surface between two said contact surfaces, said end surface out of contact with said base surface on said groove.

5. The assembly of claim 4, wherein:

said end surface is curved.

6. The assembly of claim 4, wherein:

said base surface is flat and said opposing end surfaces each form an included angle of about 135° with said base surface.

7. The assembly of claim 6, wherein:

said opposing end surfaces and said contact surfaces on said dog are flat and disposed parallel to each other.

8. A method of increasing the capacity for a wireline lock assembly, comprising:

providing a plurality of dogs which can be radially outwardly actuated through a conforming window in a tubular housing by movement of a fishing neck within said tubular housing;

configuring the contact between said dogs and said fishing neck in a manner which will reduce radial loads imposed by said dogs in a direction toward a central axis of said fishing neck.

9. A method of increasing the capacity for a wireline lock assembly, comprising:

providing a plurality of dogs which can be outwardly actuated by movement of a fishing neck;

configuring the contact between said dogs and said fishing neck in a manner which will reduce radial loads imposed by said dogs in a direction toward a central axis of said fishing neck;

providing a groove with end surfaces at obtuse angles to a base of said groove on said fishing neck;

providing contact surfaces on said dogs to engage said end surfaces on said groove.

10. The method of claim 9, comprising:

providing no contact of said dog with said base of said groove.

11. The method of claim 10, comprising:

providing a curved end surface on said dog to avoid contact with said base of said groove.

12. The method of claim 11, comprising:

providing an included angle of at least about 135° between said end surface of said groove and said base of said groove.

13. The method of claim 12, comprising:

orienting said base of said groove in a plane generally perpendicular to a line extending radially from a central axis of said fishing neck.

* * * * *